US008973420B2

(12) United States Patent
Nanaarashi et al.

(10) Patent No.: US 8,973,420 B2
(45) Date of Patent: Mar. 10, 2015

(54) CORRUGATED FIN MANUFACTURING APPARATUS

(75) Inventors: Toshiyuki Nanaarashi, Tokyo (JP); Keiichi Morishita, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 923 days.

(21) Appl. No.: 13/030,482

(22) Filed: Feb. 18, 2011

(65) Prior Publication Data

US 2011/0203341 A1 Aug. 25, 2011

(30) Foreign Application Priority Data

Feb. 19, 2010 (JP) ..... 2010-034932

(51) Int. Cl.
*B21D 13/02* (2006.01)
*B21D 13/06* (2006.01)
*B21D 53/02* (2006.01)

(52) U.S. Cl.
CPC ..... *B21D 13/06* (2013.01); *B21D 53/02* (2013.01)
USPC ..... 72/385; 72/381; 72/403

(58) Field of Classification Search
CPC ..... B21D 13/02
USPC ..... 72/380, 381, 384–386, 308, 403, 414, 72/394, 347
See application file for complete search history.

(56) References Cited

U.S. PATENT DOCUMENTS 3,892,119 A * 7/1975 Miller et al. ..... 72/385
5,694,803 A * 12/1997 Ervin et al. ..... 72/385
7,340,935 B2 * 3/2008 Ohtsuka et al. ..... 72/385

FOREIGN PATENT DOCUMENTS

JP 60003920 A * 1/1985
JP 4-371322 A 12/1992
JP 9-155461 A 6/1997

* cited by examiner

*Primary Examiner* — Edward Tolan
*Assistant Examiner* — Pradeep C Battula
(74) *Attorney, Agent, or Firm* — Birch, Stewart, Kolasch & Birch, LLP

(57) ABSTRACT

A corrugate fin manufacturing apparatus includes: a die; a machining punch inserted into a concave in the die to form a rib, wherein on entering the concave, the machining punch does not contact a part of a plate-like body that has not been machined into ribs or does not cause resistance to drawing in of the unmachined part during formation of a rib even when there is contact; a mounting portion provided on the die; and a flat punch provided upstream of the machining punch, wherein when a rib is being formed, the flat punch is positioned to not contact the unmachined part or shaped to not cause resistance to drawing in of the machined part even when there is contact, and wherein after formation of a rib, the flat punch presses down the unmachined part and flattens the unmachined part in combination with the mounting portion.

15 Claims, 12 Drawing Sheets

MOLDING COMPLETED

DURING MOLDING
MOLDING COMPLETED
BOTTOM DEAD CENTER
43
43a
31h
31
37
41a
36b
41
40
12
36

BEFORE MOLDING

DURING MOLDING OF RIBS

MOLDING OF RIBS COMPLETED

BOTTOM DEAD CENTER
41
40
12
36
43
43a
41f
41a
31
36b
44f
31h
37

CORRUGATED FIN MANUFACTURING APPARATUS

CROSS-REFERENCE TO RELATED APPLICATIONS

This application is based upon and claims the benefit of priority of the prior Japanese Patent Application No. 2010-34932, filed on 19 Feb. 2010, the entire contents of which are incorporated herein by reference.

FIELD

The present invention relates to a corrugated fin manufacturing apparatus that molds a corrugated fin where a plurality of ribs formed in a plate-like body made of metal are erected at predetermined intervals.

BACKGROUND

One example of a corrugated fin is depicted in FIG. 15. Note that the corrugated fin depicted in the drawing is an example of a plate fin where ribs are erected perpendicular to a plate-like body. The corrugated fin 10 has a plurality of consecutive ribs 12 formed in a metal plate-like body 9 made of aluminum or the like, and is mainly used in a heat exchanger in a vehicle radiator, an air conditioner, an EGR, or the like.

The construction disclosed in Patent Document 1 can be given as one example of a manufacturing apparatus for manufacturing the corrugated fin 10. This manufacturing apparatus is capable of molding the ribs one at a time in a single pressing where a punch and a die are closed by a single press operation of a press apparatus.

When manufacturing the corrugated fin 10, the plate-like body used as a material is drawn in between the punch and die, and if a plurality of punches and dies are used to simultaneously mold a plurality of ribs, the plate-like body will become pulled at both ends between the adjacent punches and dies, resulting in the risk of thinning and snapping of the ribs. For this reason, it has been difficult to simultaneously operate a plurality of punches and dies to simultaneously mold a plurality of ribs.

On the other hand, Patent Document 2 discloses a construction where the die is divided in the horizontal direction and is provided so as to be movable. With this construction, since the die that moves in the horizontal direction holds the side surfaces of the ribs, thinning and snapping of the ribs due to the plate-like body being pulled at both ends between the punches and dies are prevented.

FIG. 16 depicts a conventional corrugated fin manufacturing apparatus for forming one rib by a single mold closing operation.

On the downstream side in the conveying direction of the plate-like body 9, a pilot punch 13*a* is disposed on the upper mold so as to be energized downward by an energizing means such as a spring. When a mold closing operation begins, the pilot punch 13*a* is lowered before the other punch and, in combination with the die of the lower mold, enters a rib that has already been formed by the previous mold closing operation to position the plate-like body 9.

A machining punch 13*b* is disposed upstream of the pilot punch 13*a* so as to be energized downward by an energizing means such as a spring. When a mold closing operation begins, the machining punch 13*b* is lowered following the pilot punch 13*a* to press the plate-like body 9 that has been positioned by the pilot punch 13*a* onto the die 16 of the lower mold and thereby form a rib. A pressing portion 15 for applying pressure from above onto a part of the plate-like body 9 that has not been machined into ribs is formed on the upstream-side surface of the machining punch 13*b*.

A plurality of concaves are formed in the die 16 of the lower mold. A concave that is downstream in the conveying direction of the plate-like body 9 is a pilot concave 16*a* into which the pilot punch 13*a* enters. A machining concave 16*b* into which the machining punch 13*b* enters to machine a rib is formed on the upstream side of the pilot concave 16*a*. A mounting portion 17 with a flat upper surface onto which a lower surface of the unmachined part of the plate-like body 9 that is pressed by the pressing portion 15 of the machining punch 13*b* is mounted is formed on the upstream side of the machining concave 16*b*.

Since the plate-like body 9 is pulled between the machining punch 13*b* and the machining concave 16*b* of the die while the machining punch 13*b* and the machining concave 16*b* are forming a rib 12, the part that has not been machined into ribs bends upward. From the formation of a rib 12 onwards, the pressing portion 15 of the machining punch 13*b* gradually presses the upwardly bent unmachined part downward toward the die so that at a bottom dead center, the unmachined part is pressed between the pressing portion 15 of the machining punch 13*b* and the mounting portion 17 of the die 16, resulting in the unmachined part becoming flat.

Patent Document 1

Japanese Laid-Open Patent Publication No. H04-371322

Patent Document 2

Japanese Laid-Open Patent Publication No. H09-155461

SUMMARY

As described above, the pressing portion 15, which presses down the part of the plate-like body 9 that has not been machined into ribs and is bent upward to make the unmachined part flat, is formed on the conventional machining punch 13*b*. With the construction of the conventional machining punch 13*b*, at the same time as the formation of a rib 12 is completed, the pressing portion 15 presses the unmachined part onto the mounting portion 17 of the die 16 to make the unmachined part flat. Accordingly, even while a rib 12 is being molded, the pressing portion 15 presses the bent unmachined part progressively downward.

This means that even though the unmachined part needs to be sufficiently drawn in between the machining punch 13*b* and the machining concave 16*b* from the start of formation of a rib onwards, since the pressing portion 15 contacts the unmachined part and presses the unmachined part downward, even though force acts to draw the unmachined part in between the machining punch 13*b* and the machining concave 16*b*, there is increased resistance due to contact with the pressing portion 15, which means that the unmachined part is not sufficiently supplied between the machining punch 13*b* and the machining concave 16*b* during the machining of a rib. This results in the risk of the ribs thinning and snapping due to the unmachined part not being sufficiently drawn in.

The present invention was conceived in view of the problem described above and it is an object of the present invention to provide a corrugated fin manufacturing apparatus that is capable of reliably drawing in the unmachined part of the plate-like body and preventing thinning and snapping of ribs.

A corrugated fin manufacturing apparatus for forming a corrugated fin with a plurality of ribs from a plate-like body made of metal, the corrugated fin manufacturing apparatus comprising: a lower mold; an upper mold capable of moving toward and away from the lower mold; a die that is provided on the lower mold and includes a concave; a machining punch that is inserted into the concave of the die to form a rib when the upper mold and the lower mold are closed, wherein the machining punch is shaped so that when the machining punch enters the concave of the die, the machining punch does not cause resistance to drawing in of a part of the plate-like body that is present outside the concave of the die and has not been machined into ribs during formation of a rib; a mounting portion that is formed on the die upstream of the concave in a conveying direction of the plate-like body and on which the part of the plate-like body that has not been machined into ribs is mounted; and a flat punch that is provided upstream of the machining punch in the conveying direction of the plate-like body, wherein when a rib is being formed by the machining punch and the concave of the die, the flat punch does not cause resistance to drawing in of the part of the plate-like body that has not been machined into ribs during formation of a rib, and wherein the flat punch moves toward the mounting portion of the die after formation of a rib to press down the part of the plate-like body that has not been machined into ribs and, in combination with the mounting portion, press and flatten the part of the plate-like body that has not been machined into ribs. By using the above construction, the part that has not been machined into ribs is drawn between the machining punch and the die without resistance while the machining punch and the die are machining a rib. The flat punch starts to press and cause resistance to the part that has not been machined into ribs only after the formation of a rib has been completed, and operates to flatten such part. This means that while a rib is being formed, the part that has not been machined into ribs is sufficiently drawn in between the machining punch and the die, which means it is possible to prevent thinning and snapping of the ribs.

When the machining punch is shaped so that when the machining punch enters the concave of the die, the machining punch does not come into contact with the part of the plate-like body that has not been machined into ribs during formation of a rib.

The machining punch is shaped so that when the machining punch enters the concave of the die, the machining punch does not cause resistance to drawing in of the part of the plate-like body that has not been machined into ribs during formation of a rib even when the machining punch comes into contact with the part.

When a rib is being formed by the machining punch and the concave of the die, the flat punch is positioned so as to not come into contact the part of the plate-like body that has not been machined into ribs.

When the flat punch is shaped so as to not cause resistance to drawing in of the part of the plate-like body that has not been machined into ribs during formation of a rib even when the flat punch comes into contact with the part.

A plurality of concaves for forming ribs are provided in the die, the corrugated fin manufacturing apparatus comprises a plurality of machining punches that are capable of successively moving toward the die in one closing of the upper mold and the lower mold, the mounting portion is provided upstream in the conveying direction of the plate-like body of a final concave on the die for forming a final rib which is formed last, the respective machining punches are shaped so that when a next machining punch enters a concave of the die to form a next rib, the machining punches do not cause resistance to drawing in of a part of the plate-like body that is present outside the concaves of the die and has not been machined into ribs, and the flat punch is provided upstream in the conveying direction of the plate-like body of a final machining punch that forms the final rib. With the above construction, in an apparatus that is capable of forming a plurality of ribs in one closing operation of the upper mold and the lower mold, while a rib is being machined by the final machining punch and the final concave of the die, the part not machined into ribs is drawn in between the machining punch and the die without resistance. The flat punch starts to press and cause resistance to the part that has not been machined into ribs only after the formation of the final rib has been completed, and operates to flatten such part. This means that while a rib is being formed, the part that has not been machined into ribs is sufficiently drawn in between the machining punch and the die, which means it is possible to prevent thinning and snapping of the ribs. Also, even if ribs are successively machined by the respective machining punches, the plate-like body can be supplied and drawn in between the respective machining punches without resistance, which means it is possible to prevent thinning and snapping of the ribs.

The respective machining punches are shaped so that when a next machining punch enters a concave of the die to form a next rib, the machining punches do not contact the part of the plate-like body that has not been machined into ribs.

The respective machining punches are shaped so that when a next machining punch enters a concave of the die to form a next rib, the machining punches do not cause resistance even when the machining punches contact the part of the plate-like body that has not been machined into ribs.

According to the present invention, it is possible to prevent thinning and snapping of ribs that are formed.

DESCRIPTION OF EMBODIMENT(S)

First Embodiment

Preferred embodiments of a corrugated fin manufacturing apparatus according to the present invention will now be described.

Figure 1:
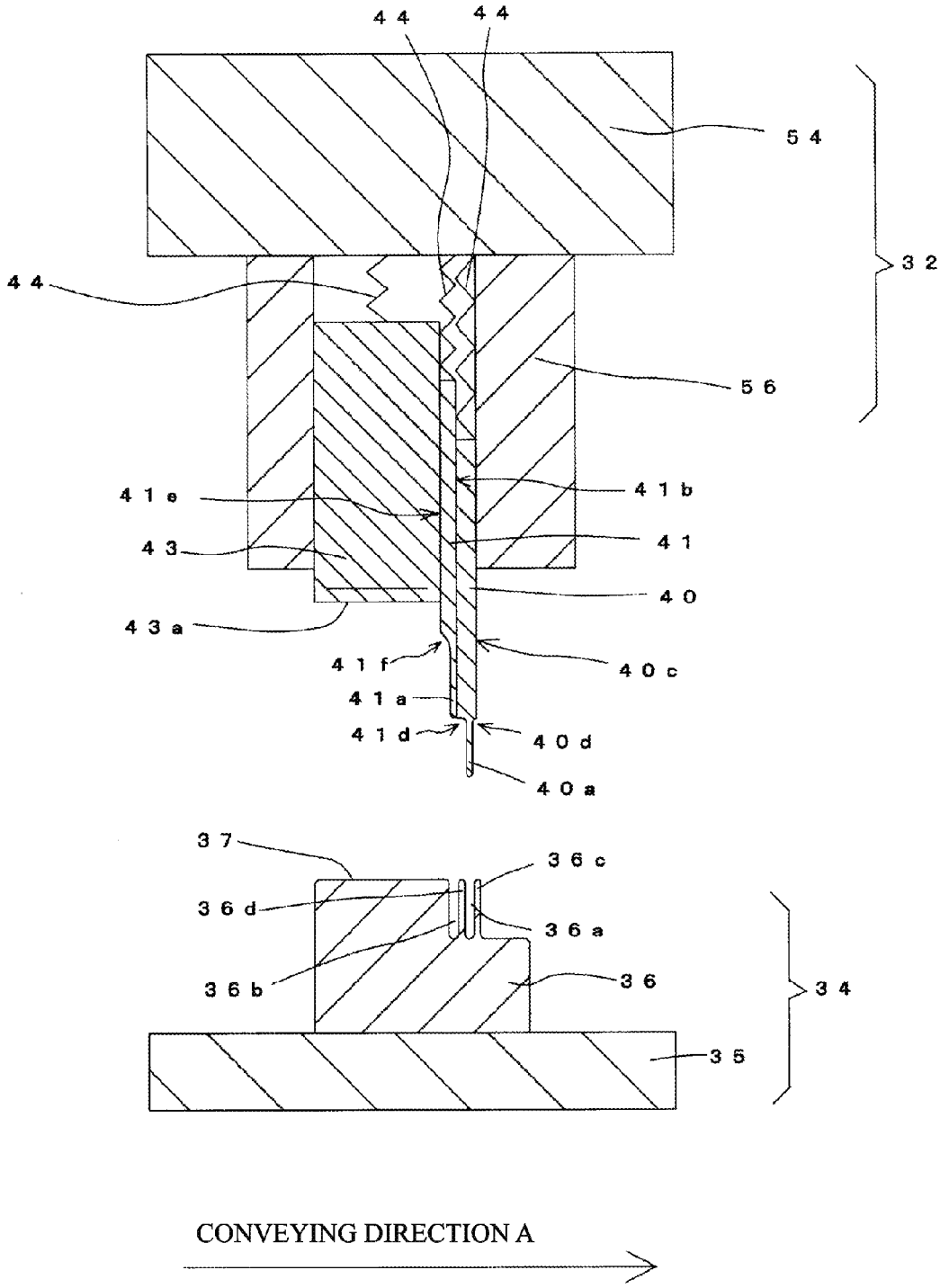
FIG. 1 is a side view depicting a punch and a die according to a first embodiment of a corrugated fin manufacturing apparatus according to the present invention.
Figures 2A, 2B, 2C:
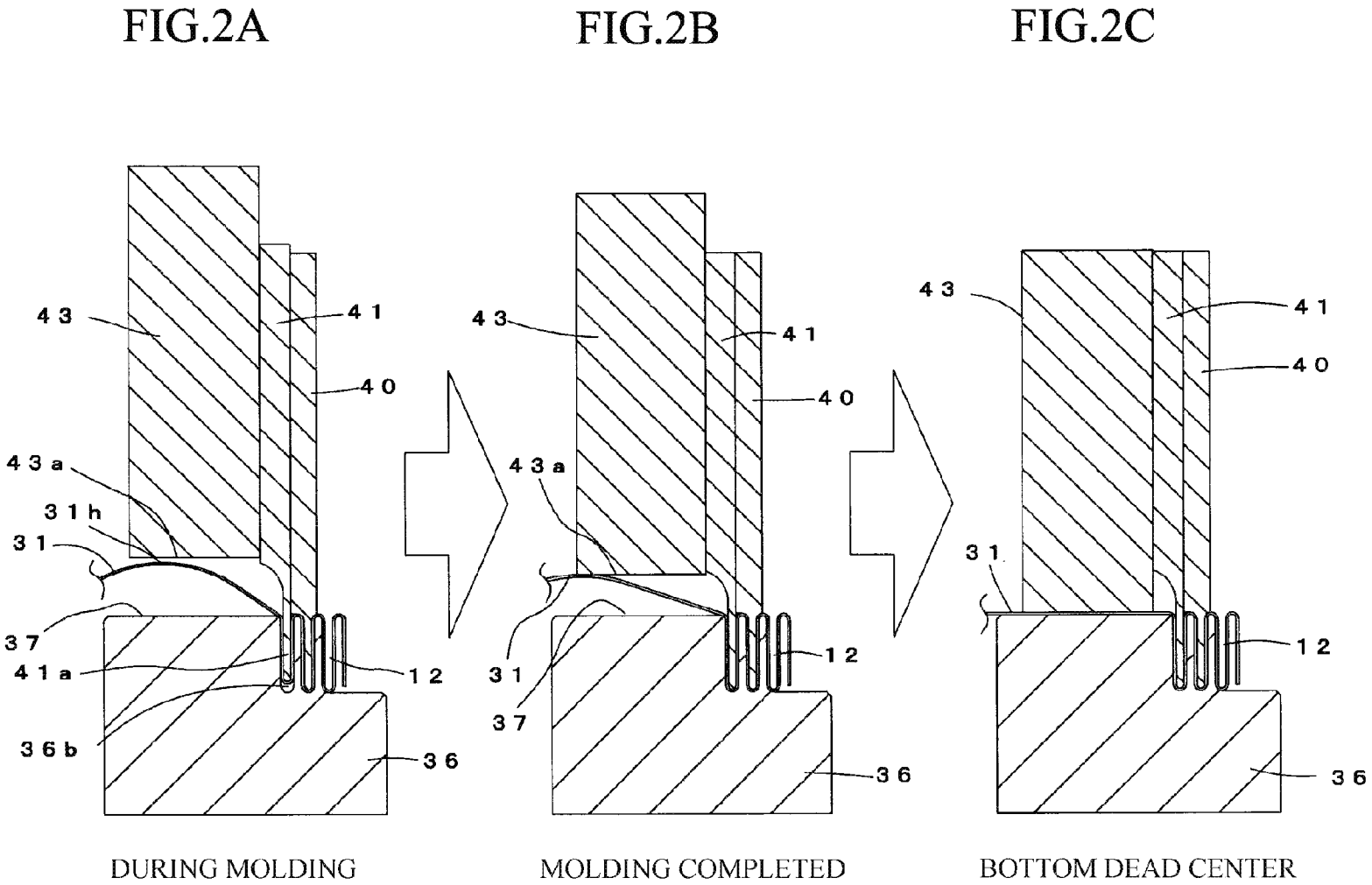
FIGS. 2A to 2C are diagrams useful in explaining the operation of the punch and a flat punch in the corrugated fin manufacturing apparatus depicted in FIG. 1.

FIG. 1 depicts a punch provided on an upper mold part of the corrugated fin manufacturing apparatus and a die provided on a lower mold part when viewed from the side. FIGS. 2A to 2C are diagrams useful in explaining the operation of the punch depicted in FIG. 1. Note that a construction of a driving means and the like for the upper mold is omitted here. Note also that the corrugated fin manufacturing apparatus according to the present embodiment is an apparatus that forms one rib in one mold closing operation of the upper mold and the lower mold.

A die 36 is fixed to the upper surface of a table 35 of a lower mold 34 and has a plurality of concave and convexes corresponding to the form of the ribs 12 of the corrugated fin to be molded. As one example, FIG. 1 depicts a state where two concaves and two convexes are formed. Out of the two concaves, a concave that is positioned downstream in the conveying direction A of a plate-like body 31 is a pilot concave 36*a* that is entered by a rib 12 that has already been formed to position the plate-like body 31. Also, out of the two concaves, the concave positioned upstream in the conveying direction of the plate-like body 31 is a machining concave 36*b* that in combination with a machining punch 41 forms a rib. A lower-end convex 41*a* of a machining punch 41, described later, enters the machining concave 36*b* to bend and machine the plate-like body 31.

A wall surface on a downstream side in the conveying direction of the pilot concave 36*a* forms a convex 36*c* with a shape that protrudes upward and is capable of entering between the ribs 12. The convex 36*c* enters a concave 40*d* on a downstream end surface of the pilot punch 40, described later, and together with the pilot punch 40 holds a rib that has already been formed. The side surface on the upstream side in the conveying direction of the pilot concave 36*a* and the side surface on the downstream side in the conveying direction of the machining concave 36*b* form a convex 36*d* with a shape that protrudes upward and is capable of entering between the ribs 12. The convex 36*d* enters between the pilot punch 40 and the machining punch 41, described later.

On the die 36, a mounting portion 37 for forming a part of the plate-like body 31 that has not been machined into ribs into a flat shape is provided upstream of the machining concave 36*b*. In the present embodiment, the height of the mounting portion 37 is the same height as the height of the convexes 36*c*, 36*d* of the die 36. This means that the part that has not been machined into ribs is formed at a position with the same height as the tops of peak parts of the ribs being formed.

The pilot punch 40 and the machining punch 41 are disposed above the die 36 along the conveying direction A of the plate-like body 31. An upper mold 32 includes a base portion 54 disposed at an upper end of the upper mold 32 and a punch holder 56 that is disposed below the base portion 54 and slidably holds the respective punches.

At a lower end portion thereof, the pilot punch 40 has a convex 40*a* with a shape capable of entering the pilot concave 36*a*. The convex 40*a* of the pilot punch 40 is disposed in substantially the center of the width of the pilot punch 40 in the conveying direction A of the plate-like body 31. An end surface 40*c* on the downstream side of the pilot punch 40 in the conveying direction A is formed as a flat, perpendicular surface. Since the convex 40*a* is formed upstream of the end surface 40*c*, the concave 40*d* is produced between the end surface 40*c* and the end surface on the downstream side of the convex 40*a* when looking from the side. When the upper mold and the lower mold are closed, the convex 36*c* of the die 36 described above enters into the concave 40*d*. The pilot punch 40 is lowered before the machining punch 41 and a rib 12 that was previously formed is sandwiched by the pilot punch 40 and the pilot concave 36*a*, thereby positioning the plate-like body 31.

The machining punch 41 that is positioned upstream of the pilot punch 40 in the conveying direction A of the plate-like body 31 is provided so as to contact the plate-like body after the pilot punch 40. On a lower end portion thereof, the machining punch 41 has a convex 41*a* with a shape capable of entering the machining concave 36*b*. The plate-like body 31 that has been positioned by the pilot punch 40 and the pilot concave 36*a* is sandwiched between the convex 41*a* of the machining punch 41 and the machining concave 36*b* to form a rib 12. In the present embodiment, an end surface 41*b* of the downstream side of the machining punch 41 includes the convex 41*a* and is formed as a substantially flat perpendicular surface. The end surface 41*b* contacts the upstream end surface of the pilot punch 40, with such surfaces being able to slide over one another.

Together with an upstream-side end surface of the pilot punch 40, the end surface 41*b* on the downstream side of the machining punch 41 forms a concave 41*d*. The concave 41*d* is formed in a shape that is capable of being entered by the convex 36*d* of the die 36, and when the upper mold and the lower mold are closed, the concave 41*d* and the convex 36*d* of the die 36 hold the upstream side of the peak of a rib that has already been formed.

Since the convex 41*a* of the machining punch 41 is formed so as to be biased toward the downstream side of the machining punch 41, a concave 41*f* is formed between an upstream end surface of the convex 41*a* and an upstream end surface 41*e* of the machining punch 41. An upper end portion of the concave 41*f* is formed at an upper position so as to not contact the part of the plate-like body 31 that has not been machined into ribs, even when the machining punch 41 has been lowered and entered inside the machining concave 36*b* to machine a rib. That is, in the present invention, the concave 41*f* on the upstream side of the convex 41*a* on the machining punch 41 is formed so as to extend higher than with the conventional art.

However, for the present invention, the upper end portion of the concave 41*f* is not limited to being formed at a position that is not contacted by the part that has not been machined into ribs. For example, provided that the plate-like body 31 can be smoothly drawn in without resistance even if the part that has not been machined into ribs is contacted, it will still be possible to prevent the ribs from thinning and snapping. In this case, if the part that has not been machined into ribs contacts the machining punch 41, the part of the machining punch 41 that is contacted should be formed with a shape or with a surface form that takes the coefficient of friction of the surface into consideration so as to make the resistance against the plate-like body 31 extremely low.

Energizing means 44 such as springs for downwardly energizing the pilot punch 40 and the machining punch 41 are respectively provided for the punches 40 and 41. Upper end portions of the energizing means 44 are connected to the base portion 54. However, the energizing means 44 is not limited to being provided above the respective punches 40, 41.

A flat punch 43 for acting in combination with the mounting portion 37 of the die 36 to sandwich and flatten the part of the plate-like body 31 that has not been machined into ribs is disposed on an upstream side of the machining punch 41 in the conveying direction A of the plate-like body 31. Note that in the embodiment depicted in FIGS. 1 and 2, the energizing means 44 for energizing the flat punch 43 downward is provided at an upper end portion of the flat punch 43 and the upper end portion of the energizing means 44 is connected to the base portion 54. However, the flat punch 43 may be attached directly to the base portion 54 with no energizing means 44 in between. A lower surface 43*a* of the flat punch 43 is formed so as to be parallel to the mounting portion 37 of the die 36 so that the plate-like body 31 that is sandwiched between the flat punch 43 and the mounting portion 37 is flattened.

The flat punch 43 in the present embodiment is formed in a substantially cubic shape and an end surface on the downstream side of the flat punch 43 slidably contacts the upstream end surface 41*e* of the machining punch 41. The position of the lower surface 43*a* of the flat punch 43 is set so as to not contact the part of the plate-like body 31 that has not been machined into ribs while a rib is being formed by the convex 41*a* of the machining punch 41 and the machining concave 36*b* of the die 36. After the formation of a rib is complete, the flat punch 43 starts moving toward the mounting portion 37 of the die 36. The flat punch 43 that has started moving presses the part of the plate-like body 31 that has not been machined into ribs downward and presses the unmachined part of the plate-like body 31 in combination with the mounting portion 37 so as to flatten the unmachined part.

Next, the operation of the respective punches and the flat punch will be described with reference to FIGS. 2A to 2C.

As depicted in FIG. 2A, first, the pilot punch 40 is lowered and enters a rib 12 that has already been formed to position the plate-like body 31. After this, the machining punch 41 is lowered and the plate-like body 31 is sandwiched between the machining punch 41 and the machining concave 36*b* to form a rib. While a rib is being formed, both the flat punch 43 and the machining punch 41 have positions and shapes that do not contact the part of the plate-like body 31 that has not been machined into ribs. Since the part that has not been machined into ribs is not contacted at any position during the formation of the ribs, the drawing-in of the plate-like body 31 between the machining punch 41 and the machining concave 36*b* of the die 36 that accompanies the formation of a rib can occur without resistance to movement of the plate-like body 31. Accordingly, it is possible to mold ribs that have sufficient thickness.

The flat punch 43 is provided so that operation thereof starts after the formation of a rib 12 by the machining punch 41 has been completed. Before operation starts, the flat punch 43 is disposed at a position that does not contact the part of the plate-like body 31 that has not been machined into ribs. More specifically, the lower surface 43*a* of the flat punch 43 is provided at a position that is higher than a highest position 31*h* of the plate-like body 31 that can be imagined in a case where the plate-like body 31 is bent.

As depicted in FIG. 2B, when the machining punch 41 has completed the formation of a rib 12, the flat punch 43 starts to be lowered. When the flat punch 43 is lowered, the lower surface 43*a* of the flat punch 43 contacts the highest position 31*h* of the plate-like body 31. After this, the flat punch 43 progressively presses down the upwardly bent part of the plate-like body 31 that has not been machined into ribs.

Here, even if the flat punch 43 presses down the part of the plate-like body 31 that has not been machined into ribs, since the molding of a rib has already been completed, there will be no further drawing in of the plate-like body 31 that accompanies the molding of a rib.

FIG. 2C depicts the bottom dead center of the upper mold 32. At this point, the part of the plate-like body 31 that has not been machined into ribs is sandwiched between the flat punch 43 and the mounting portion 37 of the die 36 so that the unmachined part of the plate-like body 31 is pressed so as to become flattened.

Note that for the operation of the flat punch 43 to start after the formation of a rib 12 by the machining punch 41 has been completed, the length of the flat punch 43 should be shorter than the length of the machining punch 41 as depicted in FIGS. 1 and 2, or alternatively when the length of the flat punch 43 is equal to the length of the machining punch 41, a position where the upper end portion of the flat punch 43 is attached to the base portion 54 should be provided higher than a position where the machining punch 41 is attached to the base portion 54. The position of the upper end portion of the flat punch 43 is positioned relative to the base portion 54 so that when the lower end portion of the convex 41*a* of the machining punch 41 has contacted an inner bottom surface of the machining concave 36*b* of the die 36, the base portion 54 presses the upper end portion of the flat punch 43 so as to cause machining by the flat punch 43.

However, the present invention is not limited to the flat punch 43 being disposed at a position that does not contact the part that has not been machined into ribs.

For example, provided that the plate-like body 31 is smoothly drawn in without resistance even if the part that has not been machined into ribs is contacted, it will still be possible to prevent thinning and snapping of the ribs. In this case, even if the part that has not been machined into ribs contacts the flat punch 43, the contacting part of the flat punch 43 should be formed with a shape or with a surface form that takes the coefficient of friction of the surface into consideration so as to make the resistance against the plate-like body 31 extremely low.

Second Embodiment

Although the embodiment described above is a corrugated fin manufacturing apparatus that forms a single rib in a single mold closing operation of the upper mold and the lower mold, the second embodiment described below is a corrugated fin manufacturing apparatus that is capable of forming a plurality of ribs in a single mold closing operation of the upper mold and the lower mold. Note that in some cases, the component elements that are the same as in the embodiment described above have been assigned the same reference numerals and description thereof is omitted.

Figure 3:
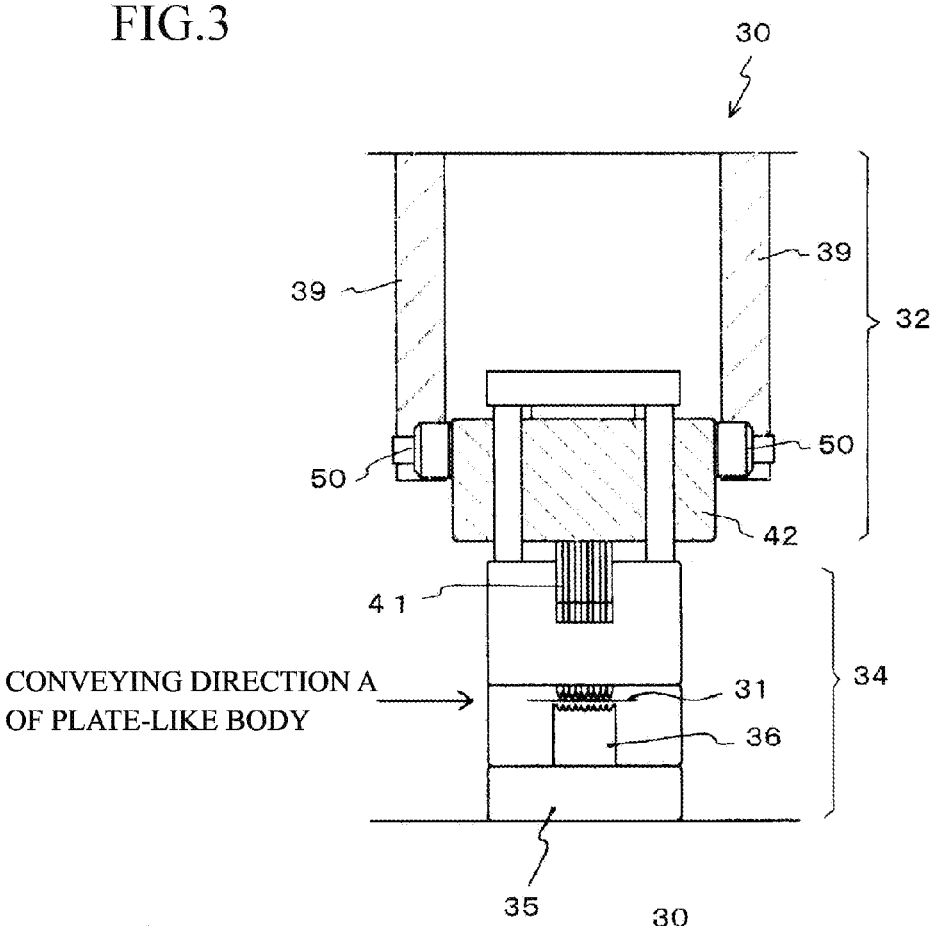
FIG. 3 is a side view of a second embodiment of a corrugated fin manufacturing apparatus according to the present invention.
Figure 4:
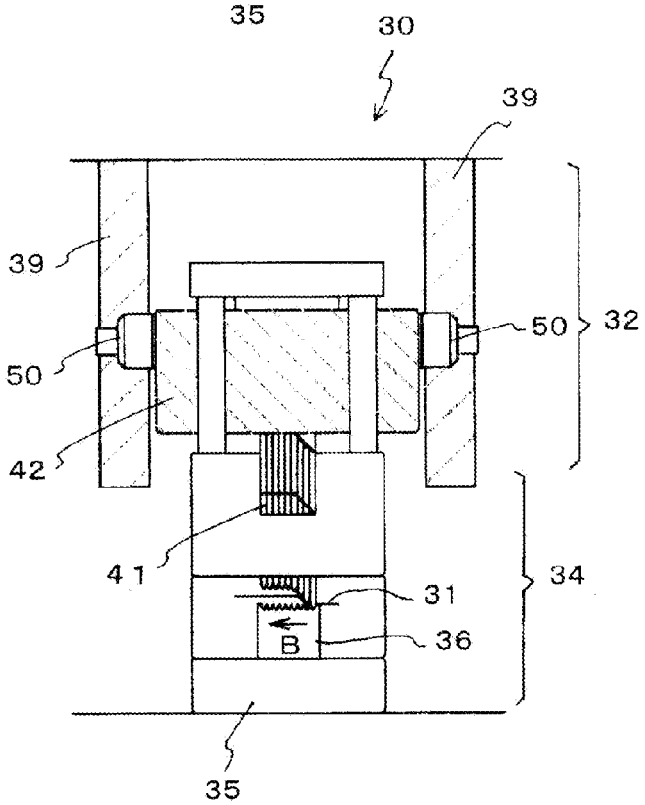
FIG. 4 is a side view of the corrugated fin manufacturing apparatus depicted in FIG. 3 when punches are successively lowered.
Figure 5:
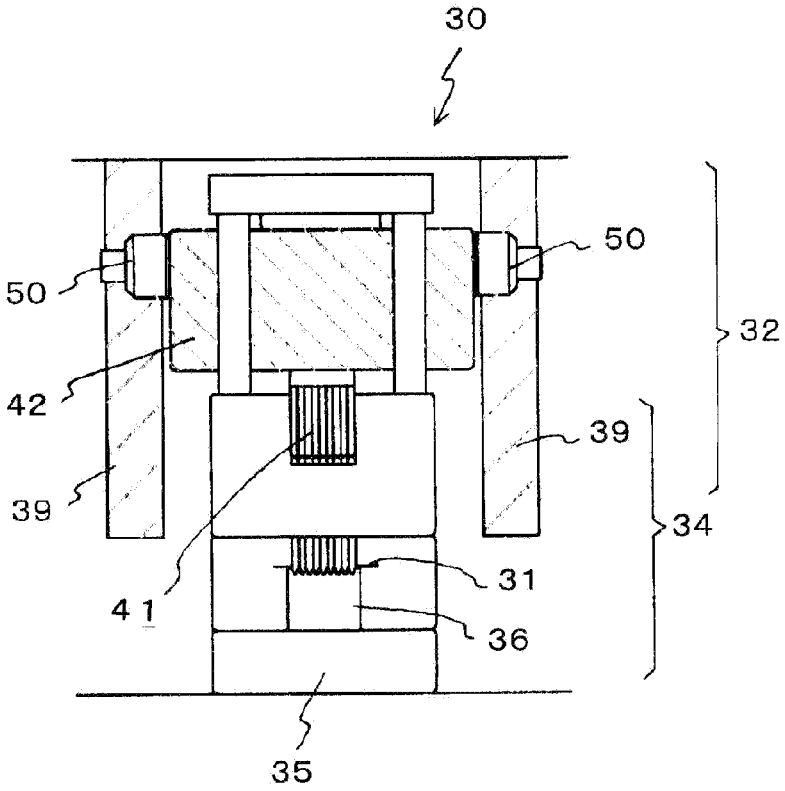
FIG. 5 is a side view depicting a state where all of the punches of the corrugated fin manufacturing apparatus depicted in FIG. 3 have been lowered and the formation of ribs is complete.
Figure 6:
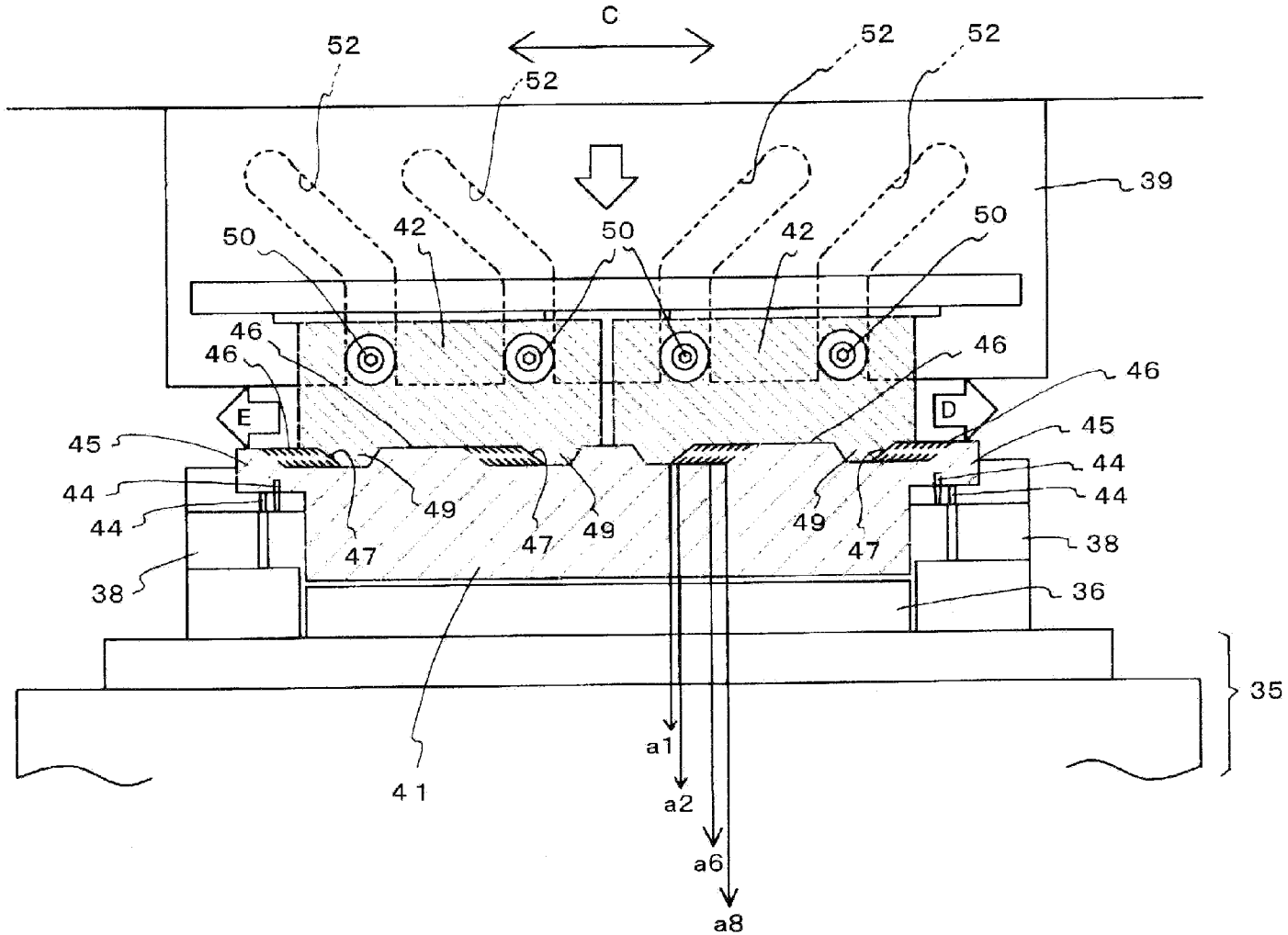
FIG. 6 is a front view of the corrugated fin manufacturing apparatus depicted in FIG. 3.
Figure 7:
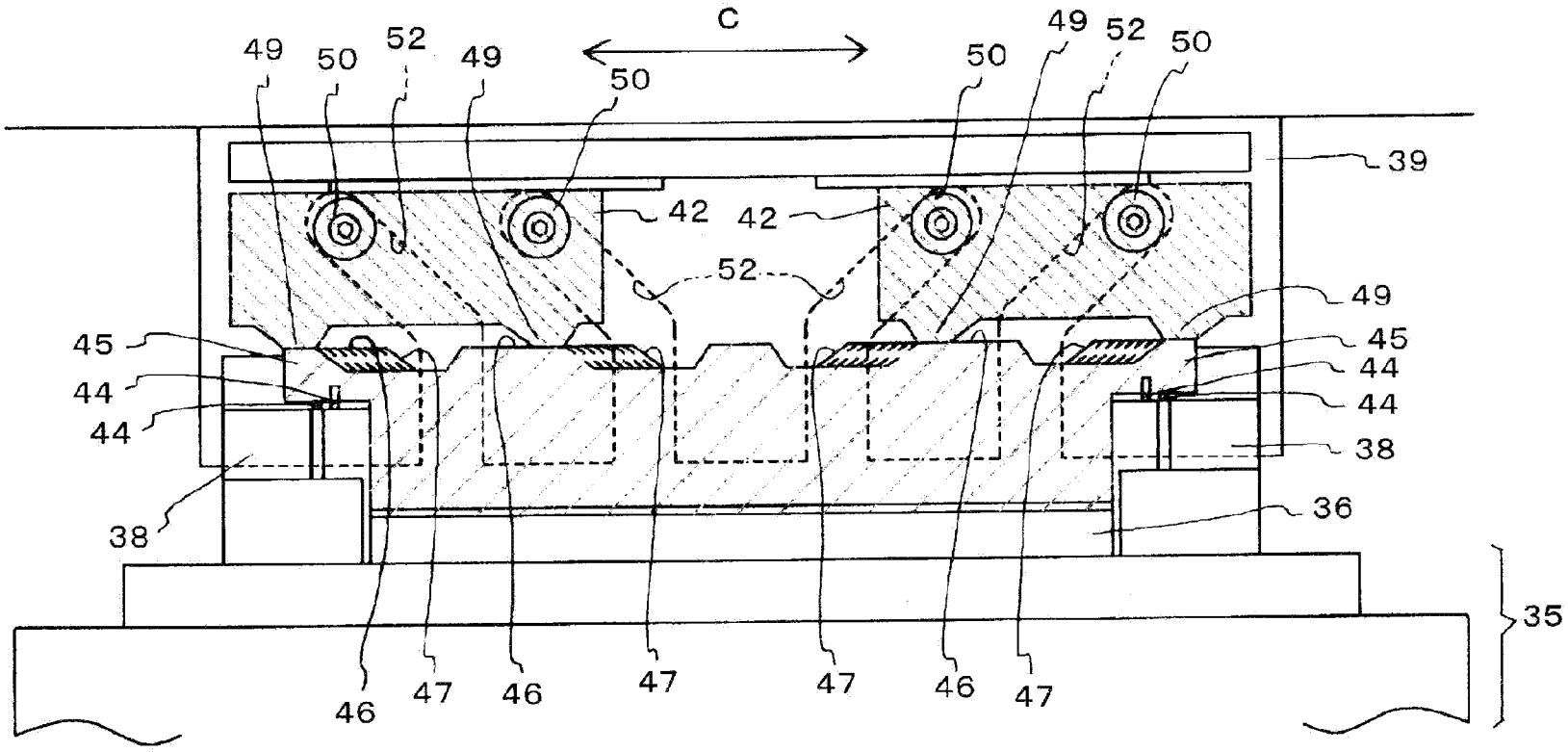
FIG. 7 is a front view depicting a state where all of the punches of the corrugated fin manufacturing apparatus depicted in FIG. 6 have been lowered and the formation of ribs is complete.

FIG. 3 is a side view depicting the overall construction of a corrugated fin manufacturing apparatus, and FIGS. 4 and 5 depict a state where the punch depicted in FIG. 3 has been driven. FIGS. 6 and 7 depict the states in FIGS. 3 to 5 from the front. The corrugated fin manufacturing apparatus 30 (hereinafter sometimes referred to simply as the "manufacturing apparatus") is an apparatus that molds a corrugated fin 10 in which a plurality of ribs 12 are formed by using a press to bend and machine a thin plate-like body 31 that is made of metal such as copper or aluminum.

The manufacturing apparatus 30 includes the lower mold 34 and the upper mold 32 that is provided so as to be capable of moving toward and away from the lower mold 34. The lower mold 34 includes the die 36 that is fixed above the table 35, the pilot punch 40, a plurality of machining punches 41, 41 . . . , the flat punch 43, and two pressing cam blocks 42 disposed above the plurality of machining punches 41, 41, . . . . The upper mold 32 includes cam plates 39 that move up and down and a driving means, not depicted. The driving means drives the cam plates 39 in the up-down direction and as one example, a hydraulic cylinder or the like that drives the cam plates 39 in the up-down direction is used.

The construction of the lower mold and the upper mold will now be described with reference to FIG. 8. First, the construction of the lower mold 34 will be described in detail.

The die 36 is fixed to the upper surface of the table 35 and has a plurality of convexes and concaves in accordance with the shapes of the ribs of the corrugated fin to be molded. FIG. 8 depicts a state where as one example, four concaves and four convexes are formed. The convexes 41*a* at the lower ends of the punches 41, described later, enter inside the concaves of the die 36 to bend and machine the plate-like body, with the convexes of the die 36 mold peak parts of the ribs 12.

The plurality of concaves of the die 36 are formed along the conveying direction A of the plate-like body 31. Out of the plurality of concaves, a concave 36*a* that is present furthest downstream in the conveying direction of the plate-like body 31 is a pilot concave 36*a* for allowing a rib 12 that has already been formed to be inserted to position the plate-like body 31. Also, out of the plurality of concaves, the concaves aside from the pilot concave 36*a* are machining concaves 36*b* which act together with the machining punches 41 to form the ribs. The convexes 41*a* at the lower ends of the respective machining punches 41, described later, successively enter the machining concaves 36*b* from the downstream side to the upstream side in the conveying direction of the plate-like body 31 to bend and machine the plate-like body 31 and thereby successively form a plurality of ribs.

A wall surface on the downstream side of the pilot concave 36*a* in the conveying direction forms the convex 36*c* with a shape that protrudes upward and is capable of entering between the ribs 12. The convex 36*c* enters the concave 40*d* on a downstream end surface of the pilot punch 40, described later, and together with the pilot punch 40 holds a rib that has already been formed. Out of the plurality of convexes of the die 36, convexes 36*d* aside from the convex 36*c* that is positioned furthest downstream in the conveying direction are inserted between the respective machining punches 41, described later.

Here, a mounting portion 37 for flattening a part of the plate-like body 31 that has not been machined into ribs is provided on the die 36 upstream of a final machining concave 36*b* that forms a final rib that is to be formed last. In the present embodiment, the height of the mounting portion 37 is equal to the height of the convexes 36*c*, 36*d* of the die 36. This means that the part that is not machined into ribs is flattened at a position with the same height as the tops of peak parts of the ribs being formed.

A plurality of punches are disposed along the conveying direction A of the plate-like body 31 above the die 36. Out of the plurality of punches, the punch that is furthest downstream in the conveying direction A of the plate-like body 31 is the pilot punch 40. At a lower end portion thereof, the pilot punch 40 has the convex 40*a* with a shape capable of entering the pilot concave 36*a*. The convex 40*a* of the pilot punch 40 is disposed in substantially the center in the width of the pilot punch 40 in the conveying direction A of the plate-like body 31. The end surface 40*c* on the downstream side in the conveying direction A of the pilot punch 40 is formed as a flat, perpendicular surface. Since the convex 40*a* is formed upstream of the end surface 40*c*, the concave 40*d* is produced between the end surface 40*c* and the end surface on the downstream side of the convex 40*a* when looking from the side. When the upper mold and the lower mold are closed, the convex 36*c* of the die 36 described above enters into the concave 40*d*. The pilot punch 40 is lowered before the machining punches 41 and a rib 12 that has been previously formed is sandwiched by the pilot punch 40 and the pilot concave 36*a*, thereby positioning the plate-like body 31.

A plurality of machining punches 41 are disposed upstream of the pilot punch 40 in the conveying direction A of the plate-like body 31 and are provided so as to be successively lowered from the downstream side to the upstream side in the conveying direction to bend and machine the plate-like body 31. On a respective lower end portion thereof, each machining punch 41 has a convex 41*a* with a shape capable of entering one of the machining concaves 36*b*. The plate-like body 31 that has been positioned by the pilot punch 40 and the pilot concave 36*a* is successively sandwiched between the convexes 41*a* of the machining punches 41 and the machining concaves 36*b* to successively form a plurality of ribs 12.

The convexes 41*a* of the machining punches 41 are formed so as to be biased toward the downstream side. This means that on each machining punch 41, a concave 41*f* is formed between an upstream end surface of the convex 41*a* and an upstream end surface 41*e* of a main part of the machining punch 41. The upper end portion of the concave 41*f* is formed at an upper position so as to not contact the part of the plate-like body 31 that has not been machined into ribs, even while a next rib is being machined by a next machining punch 41 entering the corresponding machining concave 36*b* after a present rib has been machined by the present machining punch 41 entering the corresponding machining concave 36*b*. That is, in the present embodiment, the concave 41*f* on the upstream side of the convex 41*a* on a machining punch 41 is formed so as to extend higher than with the conventional art. By doing so, during the machining of ribs, the machining punches 41 do not cause resistance to the drawing in of the plate-like body 31.

However, for the present invention, the upper end portion of the concave 41*f* is not limited to being formed at a position that is not contacted by the part that has not been machined into ribs.

For example, in the same way as the embodiment described above, provided that the plate-like body 31 can be smoothly drawn in without resistance even if the part that has not been machined into ribs is contacted, it will still be possible to prevent the ribs from thinning and snapping. In this case, if the part unmachined into ribs contacts the machining punches 41, the parts of the machining punches 41 that are contacted should be formed with a shape or with a surface form that takes into consideration the coefficient of friction of the surface so as to make the resistance against the plate-like body 31 extremely low.

The flat punch 43 for acting in combination with the mounting portion 37 of the die 36 to sandwich and flatten the part of the plate-like body 31 that has not been machined into ribs is disposed on an upstream side in the conveying direction A of the plate-like body 31 of a final machining punch 41 that is positioned furthest upstream in the conveying direction A of the plate-like body 31 out of the plurality of machining punches 41. The lower surface 43*a* of the flat punch 43 is formed so as to be parallel to the mounting portion 37 of the die 36 so that the plate-like body 31 that is sandwiched between the flat punch 43 and the mounting portion 37 is flattened.

The flat punch 43 in the present embodiment is formed in a substantially cubic shape and an end surface on the downstream side of the flat punch 43 slidably contacts the upstream end surface 41*e* of the final machining punch 41. The position of the lower surface 43*a* of the flat punch 43 is set so as to not contact the part of the plate-like body 31 that has not been machined into ribs while a rib is being formed by the final machining punch 41 and the corresponding machining concave 36*b* of the die 36. After the formation of ribs is complete, the flat punch 43 starts moving toward the mounting portion 37 of the die 36. The flat punch 43 that has started moving presses the part of the plate-like body 31 that has not been machined into ribs downward and presses the unmachined part of the plate-like body 31 in combination with the mounting portion 37 so as to flatten the unmachined part.

However, the present invention is not limited to the flat punch 43 being disposed at a position that does not contact the part that has not been machined into ribs.

For example, provided that the plate-like body 31 is smoothly drawn in without resistance even if the part that has not been machined into ribs is contacted, it will still be possible to prevent the ribs from becoming thin and snapping. In this case, even if the part that has not been machined into ribs contacts the flat punch 43, the contacting part of the flat punch 43 should be formed with a shape or with a surface form that takes the coefficient of friction of the surface into consideration so as to make the resistance against the plate-like body 31 extremely low.

Figure 8:
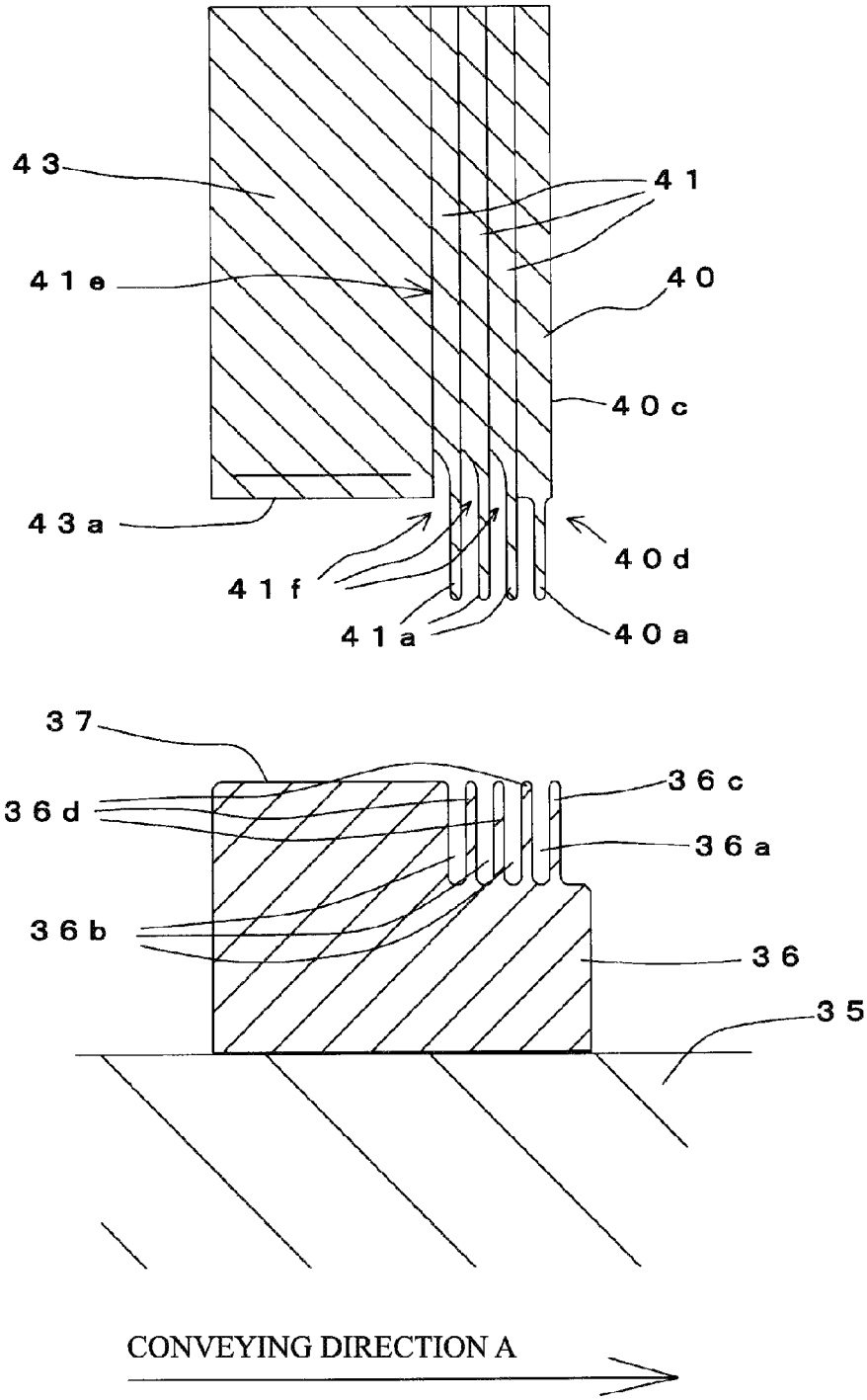
FIG. 8 is a side view depicting the punches and die in the second embodiment.

Note that although energizing means such as springs are respectively provided above the pilot punch 40, the machining punches 41, and the flat punch 43 to energize such components, such energizing means are omitted from FIGS. 8 and 9. Such energizing means are provided between attachment portions 45 of the punch 40 and punch supporting portions 38 provided on the table 35 as depicted in FIGS. 6 and 7.

Figures 9A, 9B, 9C, 9D:
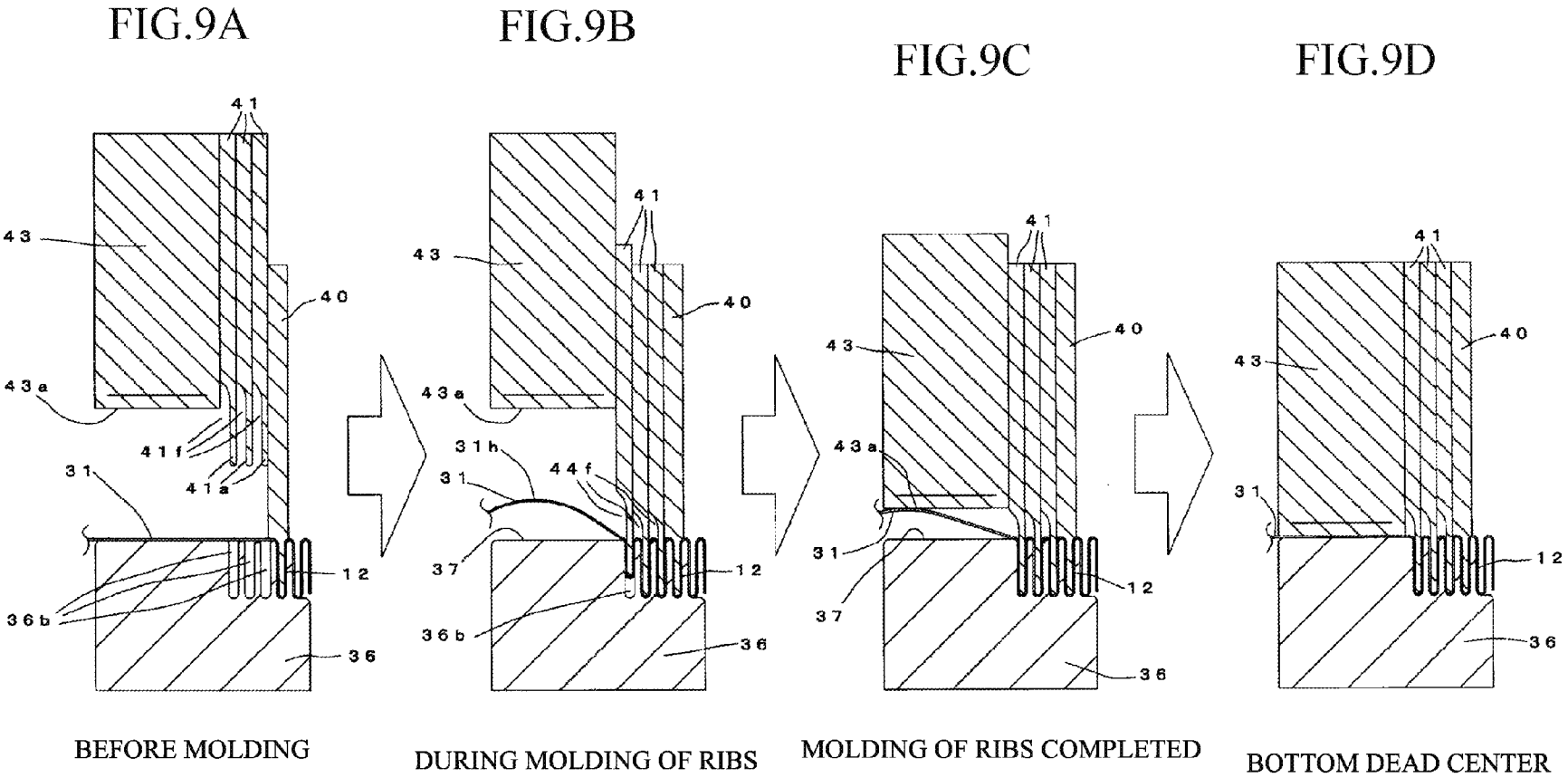
FIGS. 9A to 9D are diagrams useful in explaining the operation of the punches and flat punch in the second embodiment.

The operation of the punches and the flat punch will now be described based on FIGS. 9A to 9D. As depicted in FIG. 9A, the pilot punch 40 is lowered first and enters a rib 12 that has already been formed by a previous mold closing operation to position the plate-like body 31. Next, as depicted in FIG. 9B, the plurality of machining punches 41 are successively lowered from the downstream side in the conveying direction to successively form ribs. The flat punch 43 is provided so as to start operation following the completion of formation of the final rib 12 by the final machining punch 41. Before the operation starts, the flat punch 43 is disposed at a position so as to not contact the part of the plate-like body 31 that has not been machined into ribs. More specifically, the lower surface 43*a* of the flat punch 43 is provided at a position that is higher than a highest position 31*h* of the plate-like body 31 that can be imagined in a case where the plate-like body 31 is bent.

During the formation of the final rib 12 or ribs 12 aside from the final rib, the flat punch 43 is not lowered, and the flat punch 43 operates so as to be lowered following the completion of the formation of the final rib 12. Since the part that has not been machined into ribs is not contacted at any position during the formation of the ribs, the drawing-in of the plate-like body 31 between the machining punch 41 and the die 36 that accompanies the formation of ribs can occur without resistance to movement of the plate-like body 31. Accordingly, it is possible to mold ribs that have sufficient thickness.

As depicted in FIG. 9C, when the formation of the final rib 12 by the final machining punch 41 has been completed, the flat punch 43 is lowered. When the flat punch 43 is lowered, the lower surface 43*a* of the flat punch 43 contacts the highest position 31*h* of the plate-like body 31. After this, the flat punch 43 progressively presses down the upwardly bent part of the plate-like body 31 that has not been machined into ribs.

Here, even if the part of the plate-like body 31 that has not been machined into ribs is pressed down by the flat punch 43, since the molding of all of the ribs has already been completed, there will be no further drawing in of the plate-like body 31 that accompanies the molding of ribs.

FIG. 9D depicts the bottom dead center of the upper mold 32. At this point, the part of the plate-like body 31 that has not been machined into ribs is sandwiched between the flat punch 43 and the mounting portion 37 of the die 36 so that the unmachined part of the plate-like body 31 is pressed so as to become flattened.

Next, the construction for successively lowering a plurality of punches in a single mold closing operation will be described in detail with reference to FIGS. 6, 7, and 10. The punches 40, 41, and 43 (the pilot punch, the machining punches, and the flat punch) are formed across a wide width along a direction (hereinafter referred to as a width direction of a punch) C that is perpendicular to the conveying direction A of the plate-like body 31.

Both end portions of the punches 40, 41, 43 in the width direction C are formed as the attaching portions 45 for attaching to the table 35 of the lower mold 34 and are attached via the energizing means 44 that energize the punches upward from the punch support portions 38 provided on the table 35. In the present embodiment, a plurality of springs that are capable of being compressed in the up-down direction are used as the energizing means 44. However, such examples of the energizing means 44 are not limited to being provided at such positions.

Pressed protrusions 46, which are contacted by pressing protrusions 49 formed on lower surfaces of the pressing cam blocks 42 for driving the punches 40, 41, and 43, are formed on the upper surfaces of the punches 40, 41, and 43. Side walls 47 of the pressed protrusions 46 are formed so as to be tapered which makes it easy for the pressing protrusions 49 to ride upward. In the example in the present embodiment, the pressed protrusions 46 are formed at four positions along the width direction C on each of the punches 40, 41, and 43.

Figure 10:
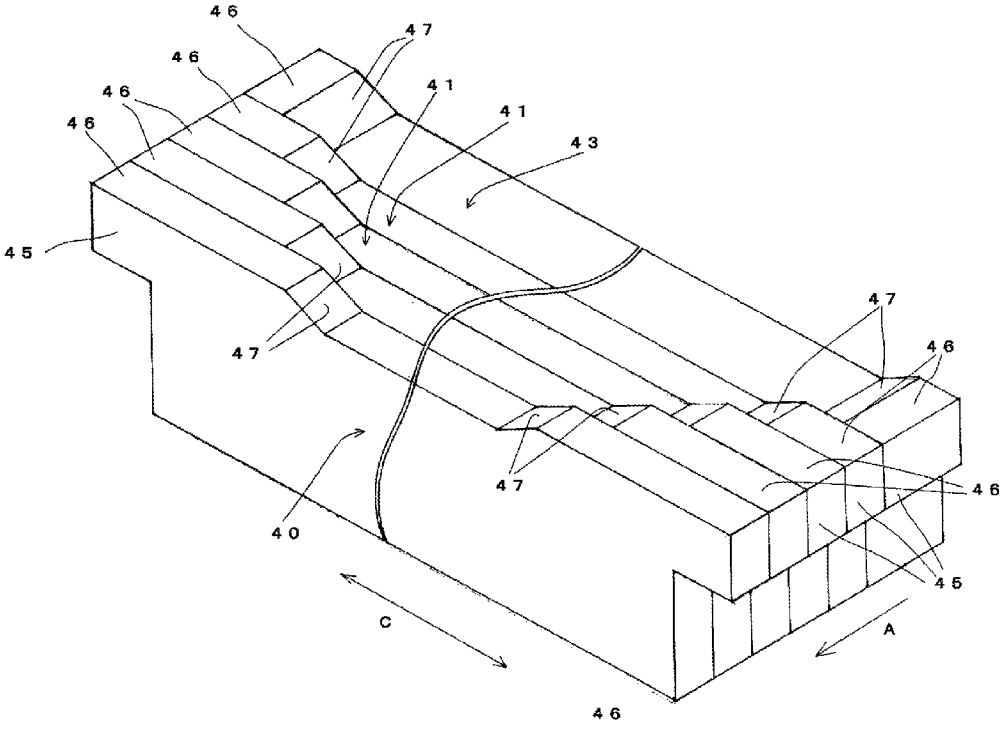
FIG. 10 is a diagram useful in explaining the shapes of the plurality of punches in the second embodiment.
Figure 11:
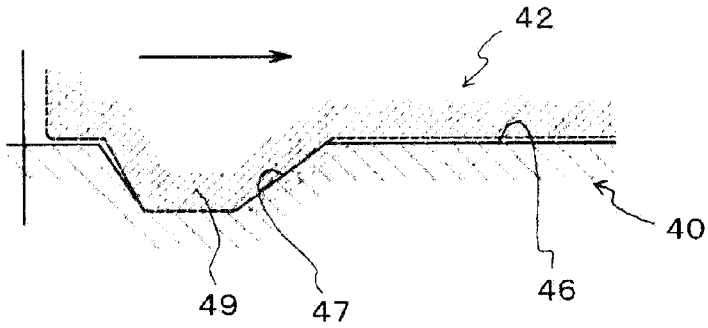
FIG. 11 is a diagram useful in depicting a state where a pressing protrusion of a pressing cam block is pressing a pressed protrusion of a punch.
Figure 12:
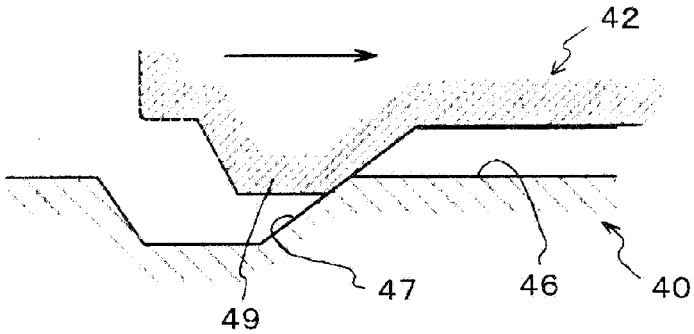
FIG. 12 is a diagram useful in depicting a state where the pressing protrusion of the pressing cam block is pressing the pressed protrusion of the punch.
Figure 13:
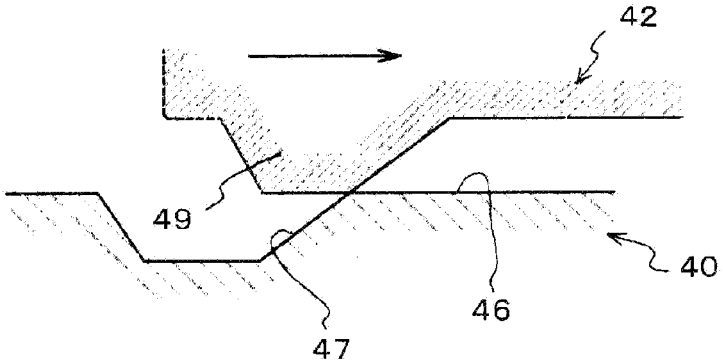
FIG. 13 is a diagram useful in depicting a state where the pressing protrusion of the pressing cam block is pressing the pressed protrusion of the punch.
Figure 14:
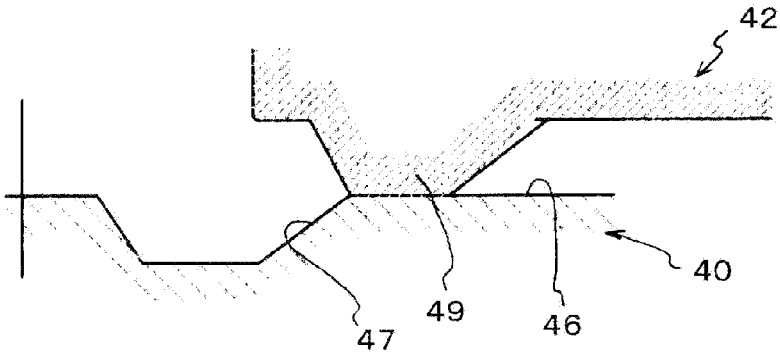
FIG. 14 is a diagram useful in depicting a state where the pressing protrusion of the pressing cam block is pressing the pressed protrusion of the punch.
Figure 15:
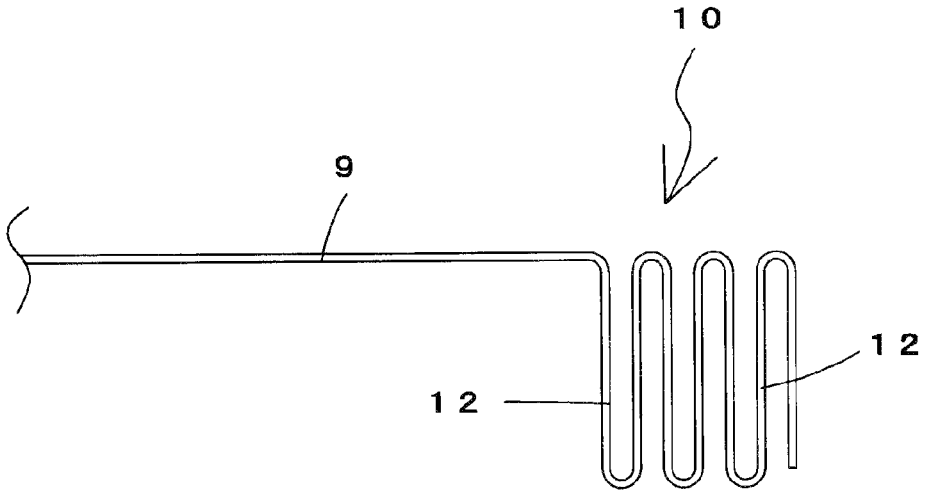
FIG. 15 is a diagram useful in depicting the external form of a corrugated fin.
Figure 16:
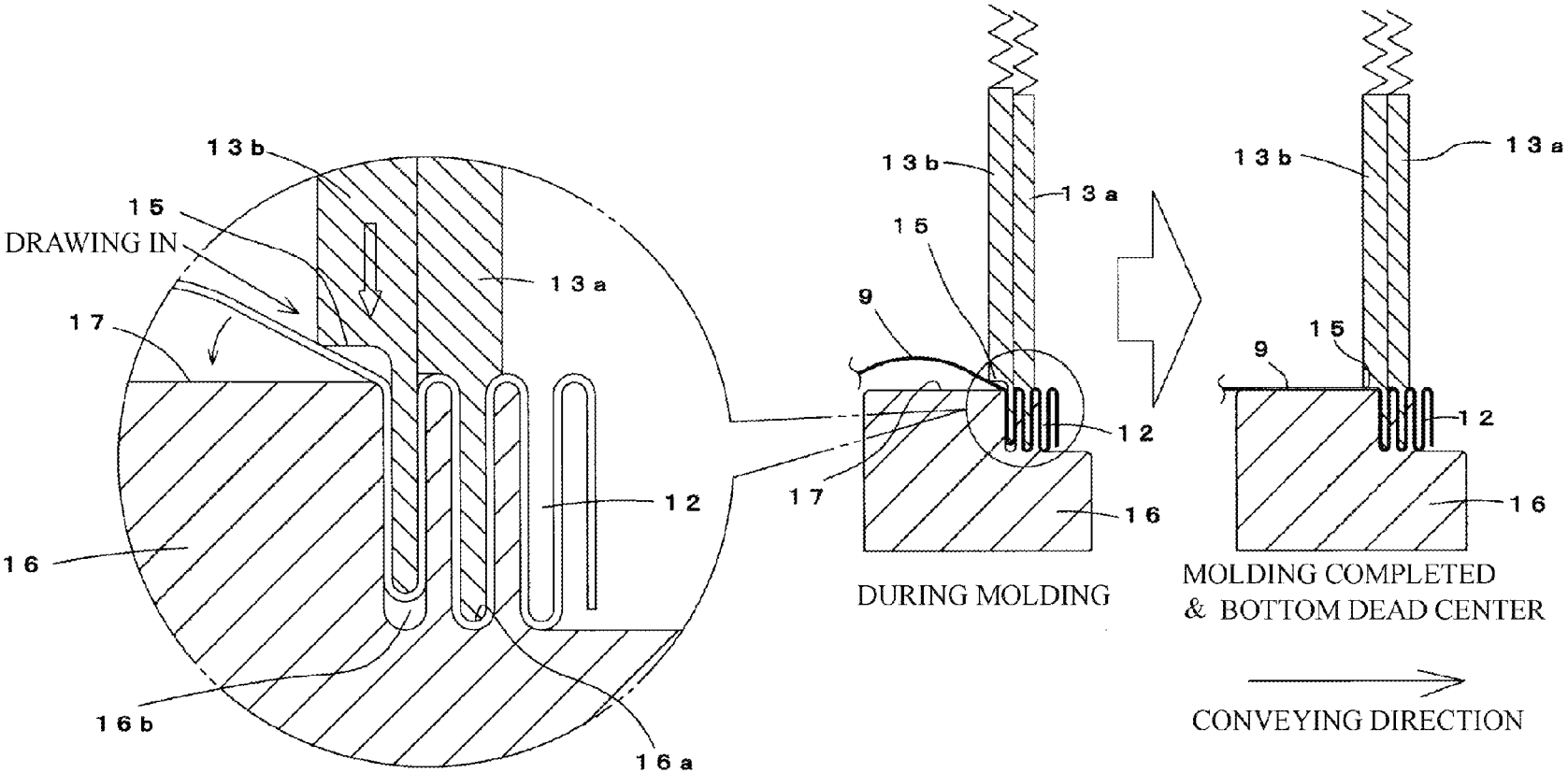
FIG.16 PRIOR ART
FIG. 16 is a diagram useful in explaining the operation of a conventional corrugated fin manufacturing apparatus.

The punches 40, 41, and 43 are formed so that the widths of the upper surfaces of the pressed protrusions 46 thereof become wider in the order in which the bending and machining of the plate-like body 31 is carried out (see FIG. 10: note however that in FIG. 10, the number of punches and the lower end portions thereof are omitted).

In the present embodiment, ribs are successively formed in the direction of the arrow B in FIG. 4 from the downstream side in the conveying direction A of the plate-like body 31. For this reason, the upper surfaces of the pressed protrusions 46 of the pilot punch 40 positioned furthest downstream in the conveying direction A of the plate-like body 31 are the widest and the upper surfaces of the pressed protrusions 46 of the punches 40, 41, and 43 are formed so as to narrow toward the upstream side in the conveying direction A. More specifically, the upper surfaces of the pressed protrusions 46 formed on the upper surface of the flat punch 43 are the narrowest out of the plurality of punches.

As depicted in FIGS. 6 and 7, out of the plurality of punches, 40, 41, and 43 (in the present embodiment, eight punches), the tapered side walls 47 of the pressed protrusions 46 on the pilot punch 40 that is lowered first toward the die 36 are formed at the closest positions (the positions a1) to the pressing protrusions 49 of the pressing cam blocks 42, and the tapered side walls 47 of the pressed protrusions 46 on the next punch to be lowered toward the die 36 are formed at the next closest position (the position a2) to the pressing protrusions 49 of the pressing cam blocks 42.

The positions of the tapered side walls 47 of the plurality of punches, 40, 41, and 43 become gradually further from the pressing protrusions 49 of the pressing cam blocks 42 in the order in which the punches are lowered toward the die 36, and the tapered side walls 47 of the pressed protrusions 46 on the flat punch 43 that is lowered toward the die 36 last, are formed at positions (the positions a8) that are furthest from the pressing protrusions 49 of the pressing cam blocks 42. Note that since the flat punch 43 is provided to start operating after the formation of the final rib 12 has been completed by the final machining punch 41, the formation positions of the side walls 47 of the pressed protrusions 46 of the flat punch 43 are formed at positions that cause the flat punch 43 to operate after the final machining punch 41 has been completely lowered.

The pressing cam blocks 42 are disposed above the punches 40, 41, and 43 at positions that constantly contact the upper surfaces of the plurality of punches 40, 41, and 43. That is, when the upper mold 32 and the lower mold 34 are open, the pressing protrusions 49 of the pressing cam blocks 42 contact positions aside from the pressed protrusions 46, and when the mold is being closed, the pressing protrusions 49 contact the pressed protrusions 46 of at least one of the punches 40, 41, and 43. Two pressing cam blocks 42 are provided with the center in the width direction C of the punches 40, 41, and 43 as a boundary between the pressing cam blocks 42 and are capable of moving along the width direction C of the punches 40, 41, and 43. The movement of the pressing cam blocks 42 is restricted by the operation of the cam plates 39 of the upper mold 32, described later.

In the present embodiment, when the upper mold 32 and the lower mold 34 are open, the two pressing cam blocks 42, 42, are positioned in substantially the center in the width direction C of the punches 40, 41, and 43 (the state in FIG. 6), and when the upper mold 32 and the lower mold 34 are closed, the two pressing cam blocks 42, 42 move along the width direction C of the punches 40, 41, and 43 so us to move apart from one another (the state in FIG. 7).

The pressing protrusions 49 that protrude downward are formed at two positions on lower surfaces of each of the pressing cam blocks 42, 42. The pressing protrusions 49 are formed in an inverse taper so as to become gradually narrower toward the bottom, and when the upper mold 32 and the lower mold 34 are open, are at positions that do not contact the pressed protrusions 46 on the upper surfaces of the punches 40, 41, and 43 (the state in FIG. 6). When the upper mold 32 and the lower mold 34 are closed, the pressing cam blocks 42, 42 move in the width direction C of the punches 40, 41, and 43 and the pressing protrusions 49 ride up the tapered side walls 47 of the widest of the pressed protrusions 46 out of the punches 40, 41, and 43 so that the punches 40, 41, and 43 are pressed down in order against the energizing force of the energizing means 44 starting with the punch with the widest pressed protrusions 46 (the state in FIG. 7).

Cain channels 52 in which bearings 50 provided on the respective pressing cam blocks 42 are housed are formed in the cam plates 39 of the upper mold 32.

Each cam channel 52 is formed in a suitable shape so as to move the pressing cam blocks 42 in the width direction C of the punches 40, 41, and 43 as the cam plates 39 are lowered. That is, the cam channels 52 are formed so as to be inclined so that the bearings 50 gradually move in the width direction C of the punches 40, 41, and 43. More specifically, the cam channels 52 provided so as to move the pressing cam block 42 that is positioned on the right out of the pressing cam blocks 42 depicted in FIG. 6 in the direction of the arrow D are formed diagonally upward to the right, and the cam channels 52 provided so as to move the pressing cam block 42 that is positioned on the left in the direction of the arrow E are formed diagonally upward to the left.

A method of manufacturing a corrugated fin is described below based on the overall operation of the manufacturing apparatus 30.

When the upper mold 32 and the lower mold 34 are opened, a conveying apparatus, not depicted, conveys the plate-like body 31 between the die 36 and the punches 40, 41, and 43. After this, a mold closing operation is started, and when the upper mold 32 is lowered toward the lower mold 34, the cam plates 39 are also lowered. The bearings 50 of the pressing cam blocks 42 are lowered along the cam channels 52 of the cam plates 39 and the pressing cam blocks 42 move in the horizontal direction.

The two pressing cam blocks 42 are respectively moved by the cam plates 39 in the horizontal direction so as to move apart (in the directions of the arrow D and the arrow E in FIG. 6). The pressing protrusions 49 provided on the respective lower surfaces of the pressing cam blocks 42 are pressed down toward the pilot punch 40 so as to ride up onto the upper surfaces of the pressed protrusions 46 of the pilot punch 40 which is the first to be lowered out of the plurality of punches, 40, 41, and 43 (see FIGS. 11 to 14).

By further moving the pressing cam blocks 42 in the horizontal direction, the punches 40, 41, and 43 are successively pressed downward in order of the width of the upper surfaces of the pressed protrusions 46 of the punches 40, 41, and 43 (i.e., in the order in which the positions of the tapered side walls 47 that rise up the pressed protrusions 46 are close to the center in the width direction C of the punches 40, 41, and 43). In combination with the die 36, the lowered machining punches 41 bend and machine the plate-like body 31. Since the plurality of machining punches 41 are successively lowered from the front in the conveying direction A of the plate-like body 31, ribs are successively formed in the plate-like body 31.

When the upper mold 32 is positioned at the bottom dead center, the pressing protrusions 49 of the pressing cam blocks 42 are positioned on the upper surfaces of the pressed protrusions 46 of the flat punch 43 that is lowered last out of the plurality of punches 40, 41, and 43. At this position, all of the punches 40, 41, and 43 have been lowered, the formation of all of the ribs by the punches 40, 41, and 43 and the die 36 is complete, and the part where ribs have not been machined is formed so as to be flat. After this, the driving means is driven to start the raising of the upper mold 32. Due to the raising of the upper mold 32, the cam plates 39 are also raised, which results in the bearings 50 of the pressing cam blocks 42 gradually moving along the cam channels 52 so as to gradually move toward the center in the width direction C of the punches 40, 41, and 43.

By doing so, the pressing protrusions 49 of the two pressing cam blocks 42 become successively separated from the upper surface of the pressed protrusions 46 of the punches 40, 41, and 43 that were pressed downward. That is, pressing by the pressing cam blocks 42 is released in the order in which the width of the pressed protrusions 46 in the width direction is narrow, and the punches for which the pressing of the pressing cam blocks 42 is released move upward in order due to the energizing force of the energizing means 44. The plurality of punches 40, 41, and 43 are raised in the opposite order to the order in which the punches were lowered, and when the pressing protrusions 49 of the pressing cam blocks 42 become separated from the pressed protrusions 46 of all of the punches 40, 41, and 43, the upper mold 32 reaches the top dead center, thereby completing one mold closing operation of the upper mold 32 and the lower mold 34.

After this, by using a conveying means, not depicted, the plate-like body 31 in which the ribs have been formed is conveyed from the manufacturing apparatus 30 to outside the apparatus to complete the manufacturing of a corrugated fin.

Note that although the upper surface of the flat punch 43 is constructed in this second embodiment so that the pressed protrusions 46 are formed in the same way as on the machining punches 41 and the pilot punch 40, with such pressed protrusions 46 being pressed to lower the flat punch 43, the upper surface may be composed of a base portion 54 and a punch holder 56 in the same way as in the first embodiment.

Note that in the second embodiment, a construction including rotating bodies may be used as the pressing protrusions of the pressing cam blocks. As such rotating bodies, it is possible to use cylindrical rollers that extend along the conveying direction A of the plate-like body 31 or spherical rollers.

In addition, the two pressing cam blocks described above are positioned so as to be centered in the width direction of the punches when the mold is open and move so as to become apart when the mold is closed. However, the movement of the two pressing cam blocks is not limited to movement in such direction. That is, it is also possible to use a construction where the two pressing cam blocks are positioned at both ends in the width direction of the punches when the mold is open and the pressing cam blocks move so as to approach one another when the mold is closed and thereby successively lower the respective punches.

Although various preferred embodiments of the present invention have been described above, it should be obvious that the present invention is not limited to such embodiments and can be subjected to a variety of modifications within a range that does not depart from the spirit of the invention.

What is claimed is:

1. A corrugated fin manufacturing apparatus for forming a corrugated fin with a plurality of ribs from a plate member made of metal, the corrugated fin manufacturing apparatus comprising:

a lower mold;

an upper mold capable of moving toward and away from the lower mold;

a die provided on the lower mold and including a concave;

a machining punch that is inserted into the concave of the die to form a rib when the upper mold and the lower mold are closed, wherein the machining punch is shaped so that when the machining punch enters the concave of the die, the machining punch does not cause resistance to drawing in of a part of the plate member that is present outside the concave of the die and has not been machined into ribs, the machining punch having an upper portion where a first energizing member is provided a mounting portion that is formed on the die upstream of the concave in a conveying direction of the plate member and on which the part of the plate member that has not been machined into ribs is mounted; and a flat punch having a solid rectangular configuration that is separated from the machining punch and provided upstream of the machining punch in the conveying direction of the plate member and having an upper portion where a second energizing member is provided, wherein when a rib is being formed by the machining punch and the concave of the die, the flat punch which moves independently of the machining punch does not cause resistance to drawing in of the part of the plate member that has not been machined into ribs during formation of a rib, and wherein the flat punch starts to move toward the mounting portion of the die after formation of a rib by the machine punch to press down the part of the plate member that has not been machined into ribs and, in combination with the mounting portion, to press and flatten the part of the plate member that has not been machined into ribs.

2. A corrugated fin manufacturing apparatus according to claim 1, wherein when the machining punch is shaped so that when the machining punch enters the concave of the die, the machining punch does not come into contact with the part of the plate member that has not been machined into ribs during formation of a rib.

3. A corrugated fin manufacturing apparatus according to claim 2, wherein when a rib is being formed by the machining punch and the concave of the die, the flat punch is positioned so as to not come into contact the part of the plate member that has not been machined into ribs.

4. A corrugated fin manufacturing apparatus according to claim 2, wherein when the flat punch is shaped so as to not cause resistance to drawing in of the part of the plate member that has not been machined into ribs during formation of a rib even when the flat punch comes into contact with the part.

5. A corrugated fin manufacturing apparatus according to claim 1, wherein the machining punch is shaped so that when the machining punch enters the concave of the die, the machining punch does not cause resistance to drawing in of the part of the plate member that has not been machined into ribs during formation of a rib even when the machining punch comes into contact with the part.

6. A corrugated fin manufacturing apparatus according to claim 5, wherein when a rib is being formed by the machining punch and the concave of the die, the flat punch is positioned so as to not come into contact the part of the plate member that has not been machined into ribs.

7. A corrugated fin manufacturing apparatus according to claim 5, wherein when the flat punch is shaped so as to not cause resistance to drawing in of the part of the plate member that has not been machined into ribs during formation of a rib even when the flat punch comes into contact with the part of the plate member.

8. A corrugated fin manufacturing apparatus according to claim 1, wherein when a rib is being formed by the machining punch and the concave of the die, the flat punch is positioned so as to not come into contact the part of the plate member that has not been machined into ribs.

9. A corrugated fin manufacturing apparatus according to claim 1, wherein when the flat punch is shaped so as to not cause resistance to drawing in of the part of the plate member that has not been machined into ribs during formation of a rib even when the flat punch comes into contact with the part.

10. A corrugated fin manufacturing apparatus according to claim 1, wherein a plurality of concaves for forming ribs are provided in the die, the corrugated fin manufacturing apparatus comprises a plurality of machining punches that are capable of successively moving toward the die in one closing of the upper mold and the lower mold, the mounting portion is provided upstream in the conveying direction of the plate member of a final concave on the die for forming a final rib which is formed last, the respective machining punches are shaped so that when a next machining punch enters a concave of the die to form a next rib, the machining punches do not cause resistance to drawing in of a part of the plate member that is present outside the concaves of the die and has not been machined into ribs, and the flat punch is provided upstream in the conveying direction of the plate member of a final machining punch that forms the final rib.

11. A corrugated fin manufacturing apparatus according to claim 10, wherein the respective machining punches are shaped so that when a next machining punch enters a concave of the die to form a next rib, the machining punches do not contact the part of the plate member that has not been machined into ribs.

12. A corrugated fin manufacturing apparatus according to claim 10, wherein the respective machining punches are shaped so that when a next machining punch enters a concave of the die to form a next rib, the machining punches do not cause resistance even when the machining punches contact the part of the plate member that has not been machined into ribs.

13. A corrugated fin manufacturing apparatus for forming a corrugated fin which comprises:

a lower mold and an opposing upper mold which are adapted to receive a plate member to be conveyed therebetween and to be formed into the corrugated fin, said lower mold including a die having a mounting portion with a substantially flat surface and a rib portion defining convex and concave portions, said substantially flat surface of the mounting portion being positioned at the same level as the rib portion and disposed upstream of said rib portion in the conveying direction of the plate member, said upper mold including a flat punch portion provided with a substantially flat surface and a machine punch portion having a convex portion, energizing members for moving the substantially flat punch portion toward the substantially flat surface of the mounting portion independently from the machine punch portion moving toward the concave portion of the rib portion so that the substantially flat punch surface of the upper mold and the machine punch surface of the upper mold selectively engage the corresponding substantially flat surface and rib portion of the lower mold.

14. The corrugated fin manufacturing apparatus of claim 13, wherein the upper mold includes a pilot punch disposed downstream from and in sliding contact with the machine punch portion, and energizing members for independently moving the pilot punch relative to the machine punch and the substantially flat punch, toward the rib portion of the lower mold.

15. A corrugated fin manufacturing apparatus for forming a corrugated fin with a plurality of ribs from a metal plate member, which comprises:

a lower mold having a substantially flat, plate-mounting portion and a plurality of convex and concave portions defining a rib forming portion, said plate-mounting portion provided upstream of said rib forming portion, an upper mold having a flat punch portion with a surface configuration compatible with said mounting portion of the lower mold, and a machining punch portion compatible with said rib forming portion of the lower mold, a first energizing member operatively associated with the flat punch portion and a second energizing member operatively associated with the machining punch portion, said first and second energizing members independently moving said flat punch portion and said machine punch portion toward and away from said lower mold, relative to each other and relative to the lower mold, wherein when a metal plate member is introduced into the corrugated fin manufacturing apparatus, the machining punch is shaped so that when the machining punch enters the concave portions of the lower mold, it does not cause resistance to the introduction of the plate member upstream of the concave portions and after the formation of the ribs by the machining punch portion, the flat punch portion moves toward the mounting portion of the lower mold to press down on the plate member disposed upstream of the rib forming portion to press and flatten the plate member yet to be machines into ribs.

* * * * *